US006634517B2

(12) United States Patent
Cheng et al.

(10) Patent No.: US 6,634,517 B2
(45) Date of Patent: Oct. 21, 2003

(54) BASE FOR PLASTIC CONTAINER

(75) Inventors: J. John Cheng, Burr Ridge, IL (US); XiaoXu Yuan, Chicago Ridge, IL (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 09/953,772

(22) Filed: Sep. 17, 2001

(65) Prior Publication Data

US 2003/0052076 A1 Mar. 20, 2003

(51) Int. Cl.[7] ..... B65D 1/02; B65D 1/42

(52) U.S. Cl. ..... 215/373; 215/371; 220/606; 220/608

(58) Field of Search ..... 215/371, 373; 220/606, 608, 609

(56) References Cited

U.S. PATENT DOCUMENTS

| | | | | |
|---|---|---|---|---|
| 4,108,324 A | * | 8/1978 | Krishnakumar et al. | 215/373 |
| 4,134,510 A | | 1/1979 | Chang | |
| 4,247,012 A | * | 1/1981 | Alberghini | 215/373 |
| 4,249,666 A | * | 2/1981 | Hubert et al. | 215/373 |
| 4,276,987 A | * | 7/1981 | Michel | 215/373 |
| 4,381,061 A | * | 4/1983 | Cerny et al. | 215/373 X |
| 4,525,401 A | | 6/1985 | Pocock et al. | |
| 4,576,843 A | | 3/1986 | Beck et al. | |
| 4,598,831 A | | 7/1986 | Nakamura et al. | |
| 4,755,404 A | | 7/1988 | Collette | |
| 4,880,129 A | * | 11/1989 | McHenry et al. | 220/606 X |
| 4,889,752 A | | 12/1989 | Beck | |
| 4,892,763 A | | 1/1990 | Duse | |
| 4,993,566 A | * | 2/1991 | Eberle | 215/373 |
| 4,993,567 A | * | 2/1991 | Eberle, Jr. | 220/608 X |
| 5,005,716 A | * | 4/1991 | Eberle | 215/373 |
| 5,234,126 A | * | 8/1993 | Jonas et al. | 220/609 |
| RE36,639 E | | 4/2000 | Okhai | |
| 6,065,624 A | * | 5/2000 | Steinke | 215/373 X |
| 6,098,832 A | * | 8/2000 | Jentzsch et al. | 220/606 |
| 6,153,145 A | | 11/2000 | Desoutter et al. | |
| 6,176,382 B1 | * | 1/2001 | Bazlur-Rashid | 215/272 |

FOREIGN PATENT DOCUMENTS

| | | | | |
|---|---|---|---|---|
| DE | 2509583 | * | 9/1975 | 220/608 |
| EP | 0293147 | | 11/1988 | |
| EP | 0479393 | | 4/1992 | |
| EP | 0808278 | | 11/1997 | |
| JP | 4267728 | * | 9/1992 | 220/608 |

* cited by examiner

*Primary Examiner*—Sue A. Weaver
(74) *Attorney, Agent, or Firm*—Knoble & Yoshida, LLC

(57) ABSTRACT

A molded polymeric container includes a body portion having a sidewall and an integral champagne type base. The base includes a lower end that defines an annular contact ring for supporting the container with respect to an underlying surface. An annular step ring is defined immediately radially inwardly of the annular contact ring and has a radial length $L_S$. The base further has a central push-up area and a generally concave transition region interposed between the central push-up area and the annular contact ring. The transition region further includes a plurality of integrally molded radially extending ribs, each of the ribs having a length $L_R$. According to one advantageous aspect of the invention, the ratio $L_R/L_S$ is within a range of about 1.0 to about 4.0.

33 Claims, 4 Drawing Sheets

BASE FOR PLASTIC CONTAINER

BACKGROUND OF THE INVENTION

1. Field of the Invention

This invention relates broadly to the field of container making, and more specifically to blow molded plastic bottles, such as the PET bottles that are in common use today for packaging beverages. More specifically, the invention relates to an improved container and base therefor that exhibits outstanding dimensional stability even under conditions of high pressurization.

2. Description of the Related Technology

During the last twenty-five years or so, there has been a dramatic shift in the packaging of carbonated beverages, particularly, soft drinks, away from glass containers and toward plastic containers. The plastic containers initially took the form of a two-piece construction, wherein a plastic bottle having a generally hemispherical bottom was applied a separate base cup, which would permit the bottle to be stood upright. The hemispherical bottom was seen as the most desirable shape for retaining the pressure generated by the carbonation within the container. Pressures in such containers can rise to 100 p.s.i. or more when the bottled beverage is exposed to the sun, stored in a warm room, car trunk, or the like. Such plastic containers represented a significant safety advantage over glass containers when exposed to the same internal pressures. However, the two-piece construction was not economical because it required a post molding assembly step, and, also a separation step prior to reclaiming or recycling the resins forming the bottle and base cup.

During this period of development, various attempts were made to construct a one-piece, self-supporting container that would be able to retain the carbonated beverages at the pressures involved. Such a one-piece container requires the design of a base structure which will support the bottle in an upright position and will not bulge outwardly at the bottom. A variety of designs were first attempted, with most following one of two principal lines of thought. One line of designs involved a so-called champagne base having a complete annular peripheral ring. Another variety of designs is that which included a plurality of feet protruding downward from a curved bottom.

One issue that must receive the continuous attention of designers of such containers is the fact that some deformation of the container is likely to occur when high internal pressures exist within the container. All carbonated beverages create the risk of overpressurization within the container. In addition, certain carbonated beverages such as beer are also subjected to a pasteurization process in which the contents of the container are heated, typically to a temperature that is within the general range of 62–67 degrees Celsius. As the temperature rises during the pasteurization process, internal pressure also rises, typically to 2 to 2½ times higher than what occurs during the packaging of non pasteurized carbonated beverages. Further complicating the situation is the fact that the rising temperatures also tend to soften the plastic material and make it less resistant to deformation. Under these circumstances, molded plastic containers are at their most vulnerable to deformation.

Dimensional stability in molded plastic containers is most important in the base region, and particularly in the portions of the base region that are designed to support the container with respect to an underlying surface. In the case of a champagne type base, dimensional stability of the area about the annular support ring is an important concern. In the case of a footed base, it is important that the lower surface of each foot remain properly positioned and angled.

A continuing need exists for an improved molded plastic container and a base therefor that exhibits outstanding dimensional stability under conditions of relatively high pressure and temperature and, in particular, that is designed to be particularly resistant to deformation in areas of the base that are designed to support the container with respect to an underlying surface.

SUMMARY OF THE INVENTION

Accordingly, it is an object of the invention to provide an improved molded plastic container and a base therefor that exhibits outstanding dimensional stability under conditions of relatively high pressure and temperature and, in particular, that is designed to be particularly resistant to deformation in areas of the base that are designed to support the container with respect to an underlying surface.

In order to achieve the above and other objects of the invention, a molded polymeric container that is constructed according to a first aspect of the invention includes a body portion having a sidewall and an integral champagne type base. The base includes a lower end that defines an annular contact ring for supporting the container with respect to an underlying surface. An annular step ring is defined immediately radially inwardly of the annular contact ring and has a radial length $L_S$. The base further has a central push-up area and a generally concave transition region interposed between the central push-up area and the annular contact ring. The transition region further includes a plurality of integrally molded radially extending ribs, each of the ribs having a length $L_R$. According to one advantageous aspect of the invention, the ratio $L_{R/LS}$ is within a range of about 1.0 to about 4.0.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
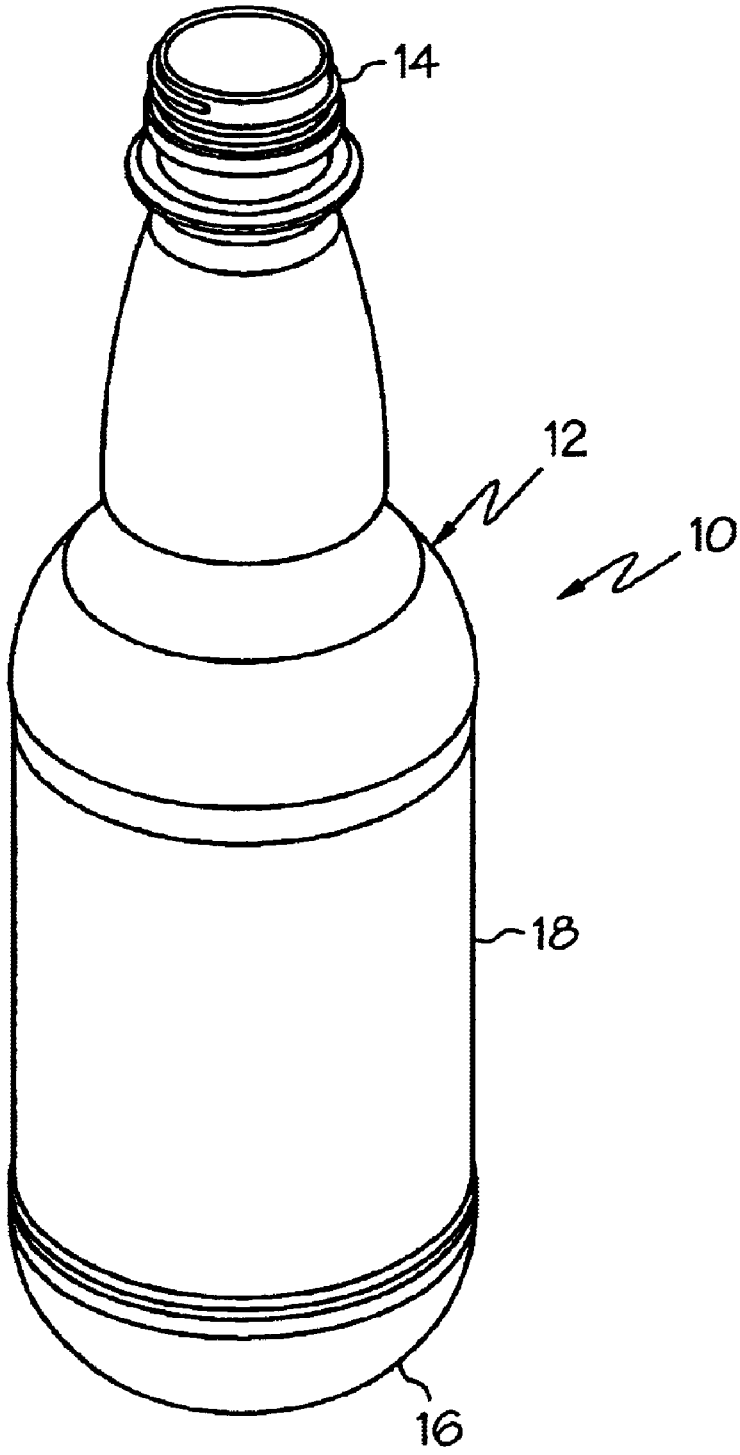
FIG. 1 is a perspective view of a container that is constructed according to a preferred embodiment of the invention.

Referring now to the drawings, wherein like reference numerals designate corresponding structure throughout the views, and referring in particular to FIG. 1, a molded polymeric container 10 that is constructed according to a preferred embodiment of the invention includes a body portion 12 having a sidewall 18. In the illustrated embodiment, container 10 is shaped so as to approximate the general shape and dimensions of a conventional long necked beer bottle. In fact, the preferred use of the container 10 of the preferred embodiment is for storing and distributing malt beverages such as beer.

As may further be seen in FIG. 1, container 10 further includes a threaded finish portion 14 to which a conventional screw type plastic closure can be attached, and a champagne type base portion 16 that is molded integrally with the sidewall 18. As may best be seen in FIGS. 2–4, champagne type base portion 16 includes a lower end 20 that defines an annular contact ring 22 for supporting the container 10 with respect to an underlying surface. Base portion 16 further is shaped to include an annular step ring 24 that is defined concentrically immediately radially inwardly and within the annular contact ring 22. Annular step ring 24 has a radial length or thickness $L_S$ within a plane extending from one location at a radial outwardmost boundary of the annular step ring 24 to the closest radially inwardmost location, as is best shown in FIG. 4.

Figure 2:
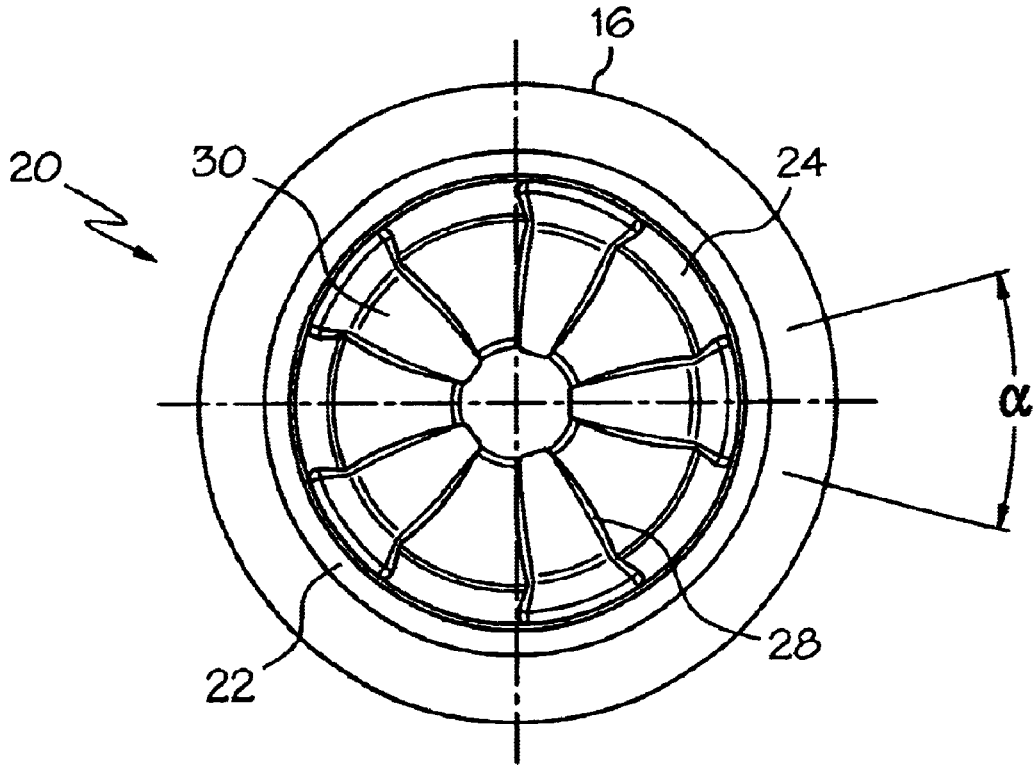
FIG. 2 is a bottom plan view of the container that is depicted in FIG. 1.
Figure 3:
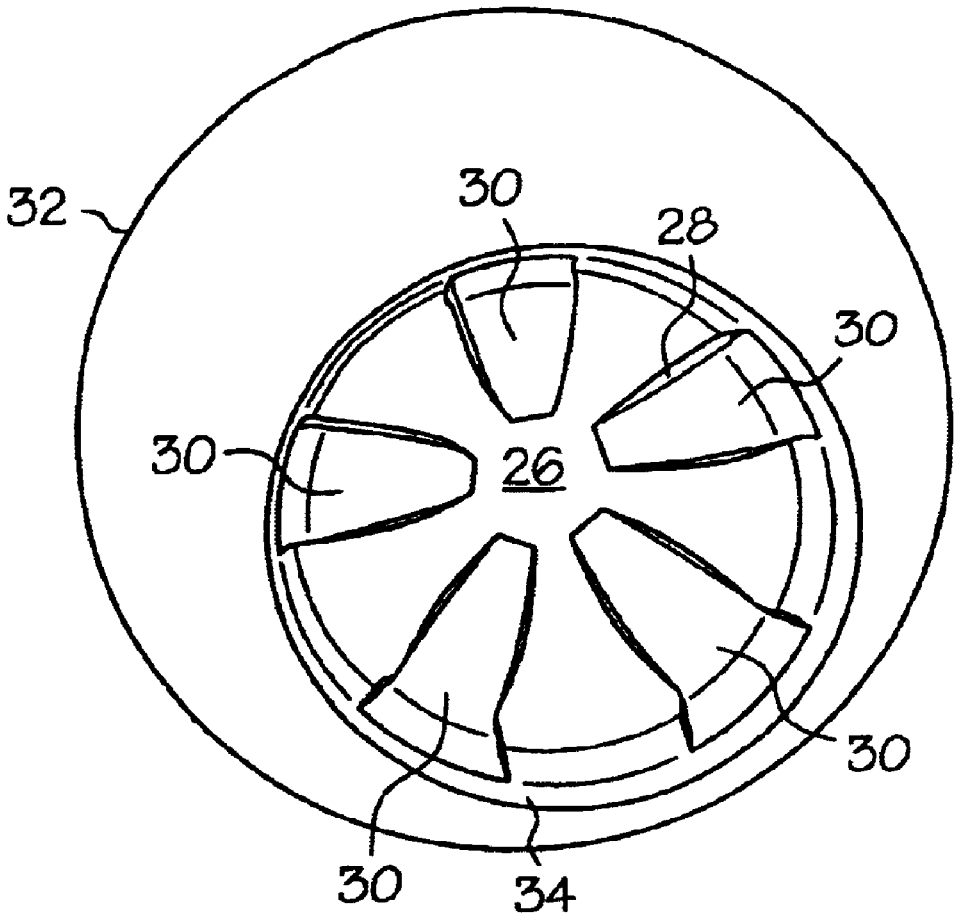
FIG. 3 is a bottom perspective view of a base portion of the container that is shown in FIGS. 1 and 2.
Figure 4:
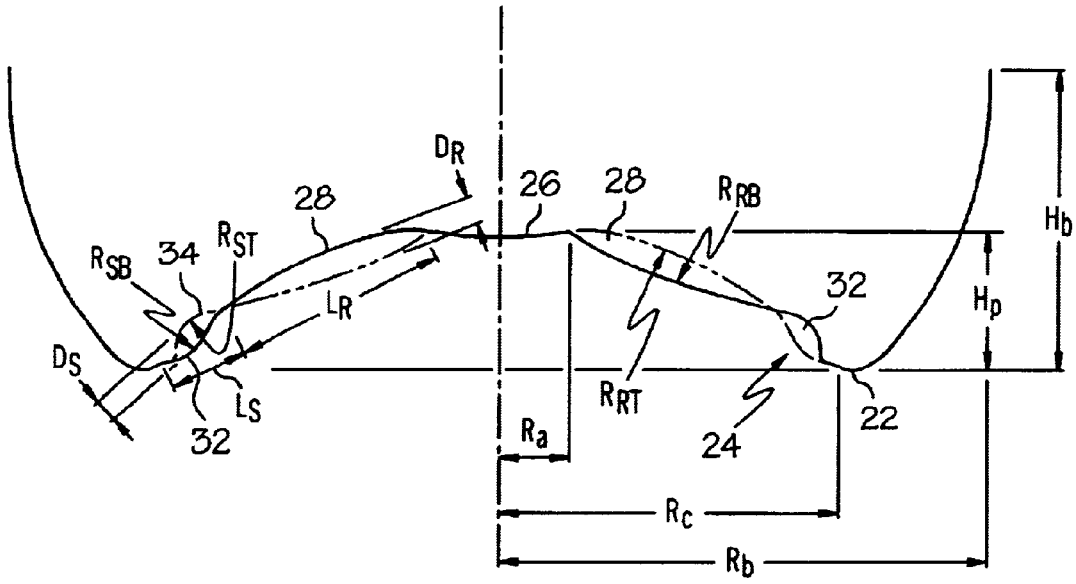
FIG. 4 is a diagrammatical view depicting the geometry of the bottom of the base portion of the container that is shown in FIG. 3.

Looking into FIGS. 2–4, base portion 16 further includes a central push-up area 26 that is elevated with respect to annular contact ring 22 by a height $H_P$, and that has a radius $R_O$. Push-up area 26 is generally circular in shape, with some deviations, as may best be seen in FIG. 2. The radius $R_O$ is calculated as the radius that defines the largest circle that could fit entirely within the push-up area 26 without contacting another element, such as a rib 30, described in further detail below.

As may best be seen in FIGS. 3 and 4, base portion 16 further is shaped so as to define a generally concave transition region 28 that is interposed between the central push-up area 26 and the annular contact ring 22. Transition region 28 is concavely curved at a median radius $R_{RT}$, as is shown in FIG. 4. It is to be understood that this curvature may vary slightly, either by design or by variations in manufacturing.

According to one particularly advantageous feature of the invention, a plurality of integrally molded radially extending ribs 30, each having a length $L_R$ and a maximum depth $D_R$, are spaced at regular angular intervals within the concave transition region 28. In the preferred embodiment, each rib 30 has a width that subtends an angle a, which is preferably about 30 degrees. Preferably, the ratio of the length $L_R$ of the radially extending ribs divided by the radial length $L_S$ is within a range of about, 1.0 to about 4.0. More preferably, the ratio of the length $L_R$ of the radially extending ribs divided by the radial length $L_S$ is within a range of about 2.5 to about 3.0. Most preferably, this ratio is about 2.7.

Preferably, maximum depth $D_R$ is within a range of about 0.05 to about 0.25 of the length $L_R$ of said radially extending ribs, and more preferably within a range of about 0.1 to about 0.18 of the length $L_R$ of said radially extending ribs. Most preferably, maximum depth $D_R$ is about 0.13 of the length $L_R$ of said radially extending ribs.

Looking into FIGS. 2–4, it will be seen that the annular step ring 24 is further segmented into a plurality of bottom steps 32 and a plurality of concave circumferentially extending top steps 34 that alternate with the bottom steps 32 about the periphery of the annular step ring 24. Each of the top steps 34 is in the preferred embodiment substantially aligned radially with one of the ribs 30, and, accordingly, each of the bottom steps 36 is aligned with a portion of the concave transition region 28 that is between two of the ribs 30. As may best be seen in FIGS. 3 and 4, each of the top steps 34 are shaped so as to curve concavely upwardly from a point where the annular step ring 24 borders the annular contact ring 22 and then continues to curve concavely downwardly to the inner boundary of annular step ring 24 with rib 30. Conversely, each of the bottom steps 32 are shaped so as to curve convexly downwardly from the point where the annular step ring 24 borders the annular contact ring 22 and then to continue curving convexly upwardly to the inner boundary of annular step ring 24 with the concave transition region 28. The combination of ribbing and step ring structure has been found to create local stress points along the contact surface or area that significantly enhances the stability of the entire lower portion of the champagne type base portion 16 under pressurization and under external loading. This results in the container that is able to sustain the high pressures and temperatures that are caused by the pasteurization process, a particularly important design consideration for plastic containers that are intended to package beverages such as beer.

As may be seen in FIG. 4, the annular step ring 24 has a depth $D_S$ that is calculated as the distance from the uppermost point of the top step 34 to the lowermost point of the bottom step 32. Preferably, the ratio of this depth $D_S$ to the length $L_S$ of the annular step ring is within a range of about 0.2 to about 0.5. More preferably, this ratio is within a range of about 0.3 to about 0.5, and most preferably is about 0.39. Also, the ratio $R_{RT}/R_{RB}$ of the convex outer radius of the rib 30 divided by the concave inner radius of the transition portion 28 is preferably within a range of about 0.6 to about 1.0. More preferably, this range is about 0.75 to about 0.9, and most preferably the ratio is about 0.82.

Each of the top steps 34 of the annular step ring 24 has a radius of curvature $R_S$, each of the bottom steps 32 similarly have a convex radius of curvature $R_{SB}$. Preferably, a ratio $R_{SB}/R_{ST}$ is within a range of about 0.5 to about 1.0, and more preferably this ratio is within a range of about 0.65 to about 0.85. Most preferably, the ratio is about 0.75. In addition, a ratio $R_O/R_B$ of the radius of the push-up area 26 divided by the radius of the entire base portion 16 is preferably within a range of about 0.15 to about 0.25, and most preferably is about 0.19.

The contact diameter of a champagne type base for a molded plastic container is a major factor in the stability performance of the base both under high-pressure conditions and during filling of the container. With a given radius of contact, it has in the past been very important, but difficult, to design a base having the proper relationship between the push-up height and the overall height of the base. In determining this relationship, attention must be given to the desired material distribution and the contact point and the stress and loading distribution in the entire base.

Another particularly advantageous feature of the invention is that a unique and beneficial methodology has been created for determining the optimum relative dimensions of the base portion of a champagne type base for a molded plastic container. Preferably, the optimum relative dimensions are determined and selected substantially according to the formula:

$$Hp = \frac{\left[Hb + 2(Rb - Rc] * \left(\frac{P}{TcRc} - 1\right) * (Rc - Ro)\right.}{2(Rb - Rc)}$$

wherein:

$H_p$ is the height of the central push-up area;

P is a preform index that is equal to the thickness $T_p$ of the preform times the middle radius $R_p$ of the preform;

$H_b$ is the height of the base portion;

$R_b$ is the maximum outer radius of the base portion;

$R_c$ is the radius of the annular contact ring;

$T_c$ is the thickness of molded plastic material in the area of the annular contact ring; and $R_o$ is the radius of the central push-up area.

Moreover, it has been found that this methodology is particularly effective when a ratio $R_c/R_b$ is within a range of about 0.65 to about 0.74, and when $T_c$ is within a range of about 0.06 to about 0.09 inches.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A molded polymeric container, comprising:

a body portion having a sidewall; and a champagne type base portion that is molded integrally with said sidewall, said champagne type base portion comprising a lower end that defines an annular contact ring for supporting the container with respect to an underlying surface;

an annular step ring defined immediately radially inwardly of said annular contact ring, said annular step ring including at least one top step and at least one bottom step, said annular step ring further having an inner radius, an outer radius and a radial length $L_s$ representing a distance between said inner and outer radii;

a central push-up area;

a generally concave transition region interposed between said central push-up area and said annular contact ring, said transition region further comprising a plurality of integrally molded radially extending ribs that are located radially inwardly of said inner radius of said annular step ring, each of said ribs having a length $L_R$; and wherein the ratio of said length $L_R$ of said radially extending ribs divided by said radial length $L_S$ is within a range of-about 1.0 to about 4.0.

2. A molded polymeric container according to claim 1, wherein the ratio of said length $L_R$ of said radially extending ribs divided by said radial length $L_S$ is within a range of about 2.5 to about 3.0.

3. A molded polymeric container according to claim 2, wherein the ratio of said length $L_R$ of said radially extending ribs divided by said radial length $L_S$ is about 2.7.

4. A molded polymeric container according to claim 1, wherein each of said radially extending ribs has a maximum depth $D_R$, and wherein said maximum depth $D_R$ is within a range of about 0.05 to about 0.25 of the length $L_R$ of said radially extending ribs.

5. A molded polymeric container according to claim 4, wherein each of said radially extending ribs has a maximum depth $D_R$, and wherein said maximum depth $D_R$ is within a range of about 0.1 to about 0.18 of the length $L_R$ of said radially extending ribs.

6. A molded polymeric container according to claim 5, wherein each of said radially extending ribs has a maximum depth $D_R$, and wherein said maximum depth $D_R$ is about 0.13 of the length $L_R$ of said radially extending ribs.

7. A molded polymeric container according to claim 1, wherein said annular step ring has a depth $D_S$, and wherein said depth $D_S$ is within a range of about 0.2 to about 0.5 of the radial length $L_S$ of the annular step ring.

8. A molded polymeric container according to claim 7, wherein said annular step ring has a depth $D_S$, and wherein said depth $D_S$ is within a range of about 0.3 to about 0.5 of the radial length $L_S$ of the annular step ring.

9. A molded polymeric container according to claim 8, wherein said annular step ring has a depth $D_S$, and wherein said depth $D_S$ is about 0.39 of the radial length $L_S$ of the annular step ring.

10. A molded polymeric container according to claim 1, wherein said generally concave transition region has a radius of curvature $R_{RB}$, and wherein each of said radially extending ribs has a convex outer radius of curvature $R_{RT}$, and wherein the ratio $R_{RT}/R_{RB}$ is within a range of about 0.6 to about 1.0.

11. A molded polymeric container according to claim 10, wherein said generally concave transition region has a radius of curvature $R_{RB}$, and wherein each of said radially extending ribs has a convex outer radius of curvature $R_{RT}$, and wherein the ratio $R_{RT}/R_{RB}$ is within a range of about 0.75 to about 0.9.

12. A molded polymeric container according to claim 11, wherein said generally concave transition region has a radius of curvature $R_{RB}$, and wherein each of said radially extending ribs has a convex outer radius of curvature $R_{RT}$, and wherein the ratio $R_{RT}/R_{RB}$ is about 0.82.

13. A molded polymeric container according to claim 1, wherein said annular step ring defines a concave circumferentially extending top step that has a radius of curvature $R_{ST}$, and a plurality of radially extending bottom steps, each of which has a convex radius of curvature $R_{SB}$.

14. A molded polymeric container according to claim 13, wherein said annular step ring is constructed and arranged so that a ratio $R_{SB}/R_{ST}$ is within a range of about 0.5 to about 1.0.

15. A molded polymeric container according to claim 14, wherein said annular step ring is constructed and arranged so that a ratio $R_{SB}/R_{ST}$ is within a range of about 0.65 to about 0.85.

16. A molded polymeric container according to claim 15, wherein said annular step ring is constructed and arranged so that a ratio $R_{SB}/R_{ST}$ is about 0.75.

17. A molded polymeric container according to claim 1, wherein said central push-up area has a radius $R_O$, and wherein said base portion has an outer radius $R_B$, and wherein the ratio $R_{RB}$ is within a range of about 0.15 to about 0.25.

18. A molded polymeric container according to claim 17, wherein the ratio $R_O/R_B$ is about 0.15 to about 0.25.

19. A molded polymeric container according to claim 18, wherein the ratio $R_O/R_B$ is about 0.19.

20. A molded polymeric container according to claim 1, wherein relative dimensions of said base portion are selected substantially according to the formula:

$$Hp = \frac{\left[Hb + 2(Rb - Rc] * \left(\frac{P}{TcRc} - 1\right) * (Rc - Ro)\right.}{2(Rb - Rc)}$$

wherein:

$H_p$ is the height of the central push-up area;

P is a preform index that is equal to the thickness $T_p$ of the preform times the middle radius R, of the preform;

$H_b$ is the height of the base portion;

$R_b$ is the maximum outer radius of the base portion;

$R_c$ is the radius of the annular contact ring;

$T_c$ is the thickness of molded plastic material in the area of the annular contact ring; and $R_o$ is the radius of the central push-up area.

21. A molded polymeric container according to claim 20, wherein a ratio $R_c/R_b$ is within a range of about 0.65 to about 0.74.

22. A molded polymeric container according to claim 21, wherein $T_c$ is within a range of about 0.06 to about 0.09 inches.

23. A molded polymeric container, comprising:

a body portion having a sidewall; and a champagne type base portion that is molded integrally with said sidewall, said champagne type base portion comprising a lower end that defines an annular contact ring for supporting the container with respect to an underlying surface;

an annular step ring defined immediately radially inwardly of said annular contact ring, said annular step ring having a radial length $L_S$ and a depth $D_S$, and wherein said depth $D_S$ is within a range of about 0.2 to about 0.5 of the radial length $L_S$ of the annular step ring;

a central push-up area;

a generally concave transition region interposed between said central push-up area and said annular contact ring, said transition region further comprising a plurality of integrally molded radially extending ribs, each of said ribs having a length $L_R$; and wherein the ratio of said length $L_R$ of said radially extending ribs divided by said radial length $L_S$ is within a range of about 1.0 to about 4.0.

24. A molded polymeric container according to claim 23, wherein said annular step ring has a depth $D_S$, and wherein said depth $D_S$ is within a range of about 0.3 to about 0.45 of the radial length $L_S$ of the annular step ring.

25. A molded polymeric container according to claim 24, wherein said annular step ring has a depth $D_S$, and wherein said depth $D_S$ is about 0.39 of the radial length $L_S$ of the annular step ring.

26. A molded polymeric container, comprising:

a body portion having a sidewall; and a champagne type base portion that is molded integrally with said sidewall, said champagne type base portion comprising a lower end that defines an annular contact ring for supporting the container with respect to an underlying surface;

an annular step ring defined immediately radially inwardly of said annular contact ring, said annular step ring having a radial length $L_S$;

a central push-up area;

a generally concave transition region interposed between said central push-up area and said annular contact ring, said transition region further comprising a plurality of integrally molded radially extending ribs, each of said ribs having a length $L_R$, said generally concave transition region having a radius of curvature $R_{RB}$, and wherein each of said radially extending ribs has a convex outer radius of curvature $R_{RT}$, and wherein the ratio $R_{RT}/R_{RB}$ is within a range of about 0.6 to about 1.0; and wherein the ratio of said length $L_R$ of said radially extending ribs divided by said radial length $L_S$ is within a range of about 1.0 to about 4.0.

27. A molded polymeric container according to claim 26, wherein said generally concave transition region has a radius of curvature $R_{RB}$ and wherein each of said radially extending ribs has a convex outer radius of curvature $R_{RT}$, and wherein the ratio $R_{RT}/R_{RB}$ is within a range of about 0.75 to about 0.9.

28. A molded polymeric container according to claim 27, wherein said generally concave transition region has a radius of curvature $R_{RB}$, and wherein each of said radially extending ribs has a convex outer radius of curvature $R_{RT}$, and wherein the ratio $R_{RT}/R_{RB}$ is about 0.82.

29. A molded polymeric container, comprising:

a body portion having a sidewall; and a champagne type base portion that is molded integrally with said sidewall, said champagne type base portion comprising a lower end that defines an annular contact ring for supporting the container with respect to an underlying surface;

an annular step ring defined immediately radially inwardly of said annular contact ring, said annular step ring having a radial length $L_S$,said annular step ring defining a concave circumferentially extending top step that has a radius of curvature $R_{ST}$, and a plurality of radially extending bottom steps, each of which has a convex radius of curvature $R_{SB}$.

a central push-up area;

a generally concave transition region interposed between said central push-up area and said annular contact ring, said transition region further comprising a plurality of integrally molded radially extending ribs, each of said ribs having a length $L_R$; and wherein the ratio of said length $L_R$ of said radially extending ribs divided by said radial length $L_S$ is within a range of about 1.0 to about 4.0.

30. A molded polymeric container according to claim 29, wherein said annular step ring is constructed and arranged so that a ratio $R_{RT}/R_{ST}$ is within a range of about 0.5 to about 1.0.

31. A molded polymeric container according to claim 30, wherein said annular step ring is constructed and arranged so that a ratio $R_{RT}/R_{ST}$ is within a range of about 0.65 to about 0.85.

32. A molded polymeric container according to claim 31, wherein said annular step ring is constructed and arranged so that a ratio $R_{RT}/R_{ST}$ is about 0.75.

33. A molded polymeric container, comprising:

a body portion having a sidewall; and a champagne type base portion that is molded integrally with said sidewall, said champagne type base portion comprising a lower end that defines an annular contact ring for supporting the container with respect to an underlying surface;

an annular step ring defined immediately radially inwardly of said annular contact ring, said annular step ring having a radial length $L_S$;

a central push-up area;

a generally concave transition region interposed between said central push-up area and said annular contact ring, said transition region further comprising a plurality of integrally molded radially extending ribs, each of said ribs having a length $L_R$; and wherein said base portion is shaped so that for any given radial cross-section one of said annular step ring and said transition region has a concave profile while the other of said annular step ring and transition region has a convex profile.

* * * * *